United States Patent [19]

Rosofsky et al.

[11] Patent Number: 4,543,679

[45] Date of Patent: Oct. 1, 1985

[54] TOOTHBRUSH ASSEMBLY COMBINING A HANDLE WITH A REPLACEABLE BRUSH ASSEMBLY AND A REPLACEABLE ORAL HYGIENE DEVICE

[75] Inventors: Paul M. Rosofsky, Willingboro, N.J.; Alfred M. Blumenfeld, Melrose Park, Pa.

[73] Assignee: Oral Ease Inc., Willingboro, N.J.

[21] Appl. No.: 433,424

[22] Filed: Oct. 8, 1982

[51] Int. Cl.[4] ..... A46B 9/04; A47L 1/08; A47L 13/12

[52] U.S. Cl. ..... 15/110; 15/104.92; 15/104.94; 15/167 R; 15/176; 128/62 A; 401/24; 401/39; 401/200; 401/201

[58] Field of Search ..... 15/172, 176, 110, 167 R, 15/145, 104.92, 104.93, 104.94; 128/62 A; 604/1, 2, 3; 401/37, 38, 39, 200, 201, 24, 40, 23, 25, 196; 132/84 R, 84 B, 84 D

[56] References Cited

U.S. PATENT DOCUMENTS

| | | | |
|---|---|---|---|
| 1,172,109 | 2/1916 | Cammack | 15/172 |
| 1,680,558 | 8/1928 | Loiselle | 15/172 |
| 1,682,325 | 8/1928 | D'Amico et al. | 15/176 |
| 1,729,167 | 9/1929 | Knapp | 128/62 A |
| 1,897,365 | 2/1933 | Duey | 15/176 |
| 1,910,984 | 5/1933 | Caruso | 15/172 |
| 2,083,595 | 6/1937 | Clarren | 128/62 A |
| 2,090,144 | 8/1937 | Palimeri et al. | 15/176 |
| 2,251,853 | 8/1941 | Pandiyan | 15/176 |
| 2,614,556 | 10/1952 | Staunt | 128/62 A |
| 2,736,917 | 3/1956 | Goldstein et al. | 15/104.94 |
| 2,829,393 | 4/1958 | Turcotte | 15/145 X |
| 2,888,008 | 5/1959 | Rosenthal | 15/110 X |
| 3,199,139 | 8/1965 | Vallis | 401/201 X |
| 3,267,512 | 8/1966 | Wiley | 401/201 |
| 4,030,199 | 6/1977 | Russell | 15/106 |
| 4,205,664 | 6/1980 | Baccialon | 128/62 A |
| 4,222,143 | 9/1980 | Tarrson et al. | 15/167 R |
| 4,296,518 | 10/1981 | Furrier et al. | 128/62 A |
| 4,319,379 | 3/1982 | Carrigan et al. | 15/176 |
| 4,411,041 | 10/1983 | Braga | 15/176 X |

FOREIGN PATENT DOCUMENTS

| | | | |
|---|---|---|---|
| 2161589 | 6/1973 | Fed. Rep. of Germany | 15/176 |
| 910732 | 2/1946 | France | 15/176 |
| 309216 | 3/1969 | Sweden | 15/176 |
| 524135 | 7/1940 | United Kingdom | 128/62 A |

*Primary Examiner*—Peter Feldman

*Attorney, Agent, or Firm*—Joseph G. Seeber

[57] ABSTRACT

A toothbrush assembly combining a toothbrush handle, a brush assembly releasably engageable with a head end of the handle, and an oral hygiene device releasably engageable with the tail end of the handle. The head end of the handle has a recess formed therein designed to provide a snap fit with a base of the brush assembly. The tail end of the handle is shaped to provide releasable engagement with a base of the oral hygiene device. The oral hygiene device can take numerous forms. For instance, the oral hygiene device can be used to apply an oral hygiene agent, such as a disclosing agent or a gum treating agent, or a herbal combination usable in oral hygiene, or a refreshing agent. Alternatively, the oral hygiene device can take the form of a stimulator.

18 Claims, 12 Drawing Figures

TOOTHBRUSH ASSEMBLY COMBINING A HANDLE WITH A REPLACEABLE BRUSH ASSEMBLY AND A REPLACEABLE ORAL HYGIENE DEVICE

BACKGROUND OF THE INVENTION

Field of the Invention

This invention relates to toothbrushes. More particularly, the invention relates to a toothbrush assembly having a generally circular brush releasably engaged with one end of a handle and an oral hygiene or care device releasably engaged with the other end of the handle.

SUMMARY OF THE INVENTION

The present invention provides an improved toothbrush assembly having a handle, a base carrying bristles or a brush assembly releasably engaged with one end of the handle, and an oral hygiene device, such as a device for massaging gums, releasably engaged with the other end of the handle.

Preferably, the brush assembly has a base with a bristle-carrying lower portion and an upper portion that is received in an upper portion of a recess formed in one end of the handle. The base carries an array of bristles, with bristles closest to the center of the base having axes extending substantially perpendicular to a plane of an upper surface of the base. The angles between the bristle axes and the plane of the upper surface decrease in a progressive manner radially outwardly from the center toward the periphery of the base. Also, the height of the bristles increases in a direction radially outwardly from the center of the base. Thus, the ends of the bristles form a concave contact surface that is complementary to the outer surface of a tooth. upper portion of the base is provided with slots so that is can be resiliently compressed during insertion of the base into the handle recess. The base then snaps back to its original configuration to prevent inadvertent removal from the recess. Preferably, the upper end of the recess is open to facilitate forcible ejection of the base from the recess.

In another embodiment, the concave contact surface is provided by bristles having axes perpendicular to the base. The height of the bristles increases progressively radially outwardly from the center of the base.

The oral hygiene device has a base that is complementary shaped to a portion of the end of the handle so that the base of the device is releasably engaged with a shaped portion of the handle. In one embodiment of the oral hygiene device, a massaging device is provided having an outer surface designed for massaging gums of a user. Preferably, the material that contacts the gums is porous so that an absorbed solution can be applied to the gums. In another embodiment, a reservoir of an oral hygiene agent in dry form is provided within the interior of a base of the oral hygiene device in such a manner that the agent is dissolved when the porous material is wetted. The porous material then controls dispensing of the dissolved agent for application to the gums or teeth of the user.

In still another embodiment, the oral hygiene device is provided with a base that fits over the tail end of the brush and is shaped so as to frictionally grip the tail end. One or more strips of a compressed material, such as cellulose, preferably previously impregnated with an oral hygiene agent, such as small flavor beads of dehydrated or freeze dried liquid, are attached to the base.

Representative agents are described in copending U.S. Patents application Ser. No. 350,198, filed Feb. 19, 1982.

In still another embodiment of the oral hygiene device, a stimulator or pick is provided with a base releasably engageable with the tail end of the handle.

In still another embodiment, the oral hygiene device is provided with a base, and a protrusion or interference bump is provided on at least one of the walls forming the base and is positioned so as to engage a portion of a recess in the handle as that the base of the oral hygiene device is releasably retained or flexibly fit within the recess.

The invention, and its objects and advantages, will become more apparent in the detailed description of the preferred embodiments hereinafter presented.

BRIEF DESCRIPTION OF THE DRAWINGS

In the detailed description of the preferred embodiments of the invention hereinafter presented, reference is made to the accompanying drawings, in which.

DESCRIPTION OF THE PREFERRED EMBODIMENTS

Figure 1:
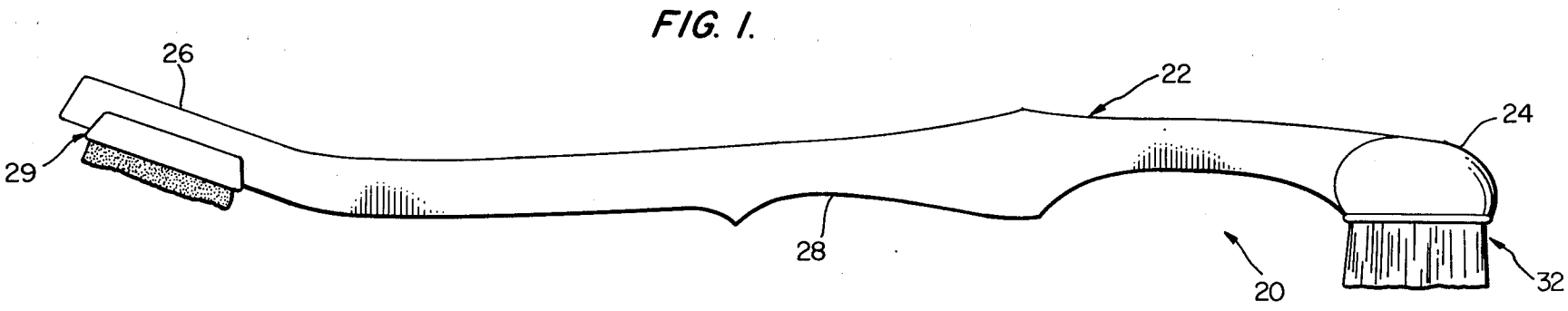
FIG. 1 is a schematic side elevation of one embodiment of a toothbrush assembly according to the present invention.

The present description will be directed in particular to elements forming part of, or cooperating more directly with, the present invention. Elements not specifically shown or described herein are understood to be selectable from those known in the art.

Referring now to the drawings, and to FIG. 1 in particular, one embodiment of the invention is illustrated and will be described in connection with a toothbrush assembly, generally designated 20. The toothbrush assembly 20 includes a handle, generally designated 22, having a head end 24, a tail end 26, and an intermediate region 28. As clearly illustrated in FIG. 1, the intermediate region 28 is shaped to facilitate engagement of the handle 22 by the user of toothbrush 20. An oral hygiene device, generally designated 29, is releasably engaged with the tail end 26 of the handle.

Figure 4:
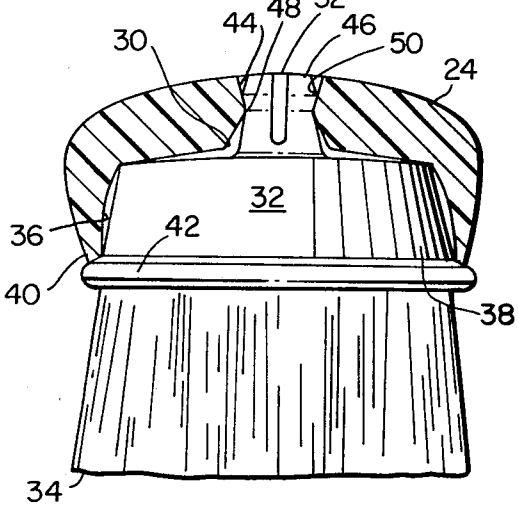
FIG. 4 is a view on line 4—4 of FIG. 3.

As best illustrated in FIG. 4, a recess 30 is formed in the head end 24 so that a base, generally designated 32, is releasably engageable with the head end 24. The base 32 carries a plurality of bristles 34, preferably arranged in a cylindrical orientation such as that described in copending U.S. patent application Ser. No. 350,198, filed Feb. 19, 1982, now U.S. Pat. No. 4,486,109.

Figure 3:
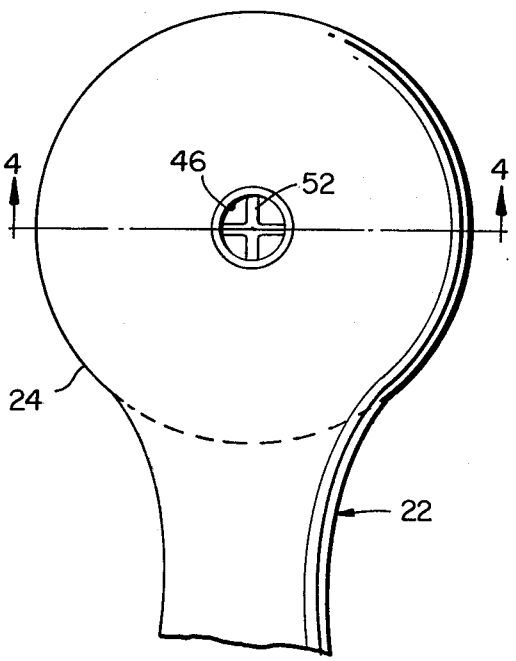
FIG. 3 is a view similar to FIG. 2 illustrating a bristle-carrying base combined with the handle.
Figure 2:
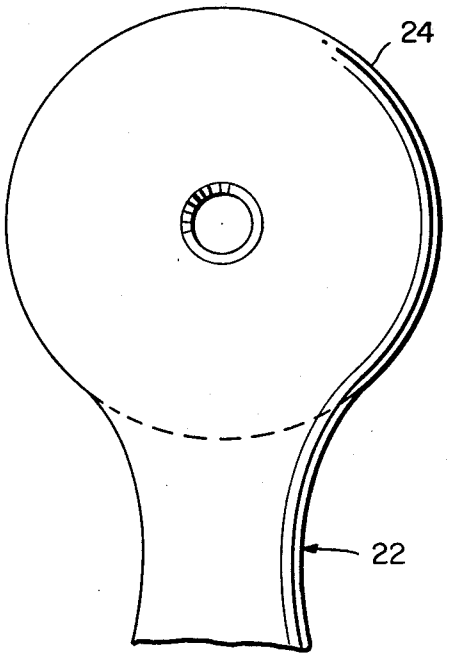
FIG. 2 is a top view, on an enlarged scale, of the head end of the handle of the toothbrush assembly of FIG. 1.

The recess 30 has a lower portion 36, preferably provided with a frustoconical shape, that receives a lower portion 38 of the base 32. A lower edge 40 of the head end 24 engages a shoulder 42 provided on the base 32 to prevent ingress of materials into the recess 30. An upper portion 44 of the recess receives an upper portion 46 of the base. Preferably, as illustrated in FIG. 4, an intermediate portion 48 of the recess portion 44 is inwardly tapered or flared. As also illustrated in FIG. 4, a portion 50 of the base 32 is outwardly tapered or flared. As illustrated in FIGS. 3 and 4, a plurality of slots 52 are provided in the base upper portion 46.

When it is desired to engage a base 32 with a head end 24, the base upper portion 46 is inserted in the recess upper portion 44. When the outwardly tapered portion 50 contacts the inwardly flared portion 48, the slots 52 enable resilient compression of the base upper portion 46. After the base portion 50 is inserted past the inwardly flared portion 48, the outwardly tapered portions 50 snap into position to prevent inadvertent removal of the base 32 from the recess 30. The upper end 44 of the recess 38 is opened to facilitate forceable ejection of the base 32 from the recess 38.

While other methods could be used to releasably engage the base with the recess, the previously described use of frictional engagement, together with the provision of slots to facilitate resilient compression of the upper portion of the base, is presently preferred because of the ease of injection moulding of the various components. Also, it should be appreciated that mating grooves and recesses can be provided on the base and walls of the recess to prevent rotation of the base.

Figure 5:
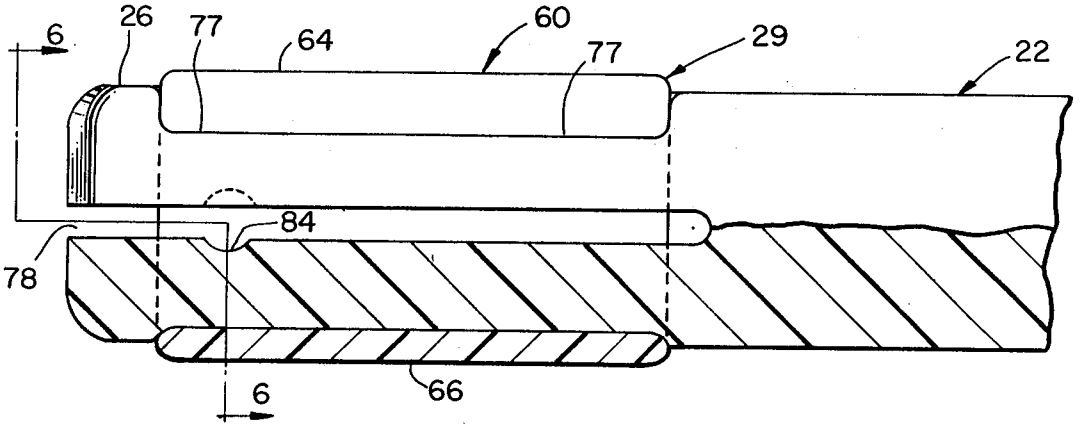
FIG. 5 is a view along line 5—5 of FIG. 6 of the oral hygiene device of the toothbrush assembly of FIG. 1, on an enlarged scale.
Figure 7:
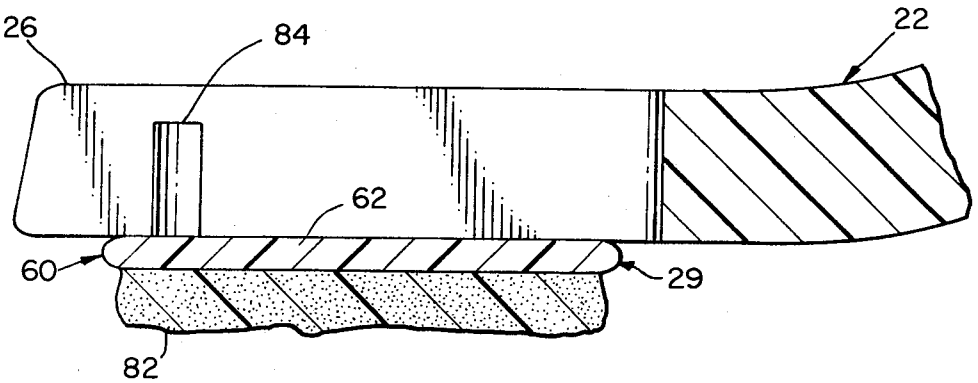
FIG. 7 is a view along line 7—7 of FIG. 6 of the oral hygiene device of the toothbrush assembly of FIG. 1, on an enlarged scale.
Figure 6:
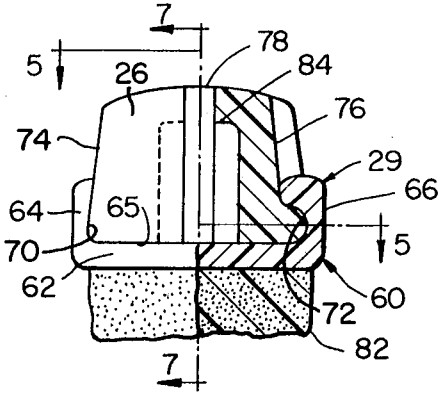
FIG. 6 is a view along line 6—6 of FIG. 5 of the oral hygiene device of the toothbrush assembly of FIG. 1, on an enlarged scale.

Referring now to FIGS. 5 to 7, it should be noted that one embodiment of the oral hygiene device 29 includes a base, generally designated 60, having a central portion 62 and upstanding flanges 64 and 66. The central portion 62 is positionable in contact with a flat lower surface 65 of the tail end 26 of the handle. The flanges 64 and 66 are shaped to mate with and encompass ledge surfaces 70 and 72 protruding outwardly from side surfaces 74 and 76 of the tail end 26. While the ledge surfaces could be replaced with recesses, protruding portions are preferable because they are easier to clean. The side surfaces 74 and 76 are provided with longitudinally extending recessed portions 77 having lengths equal to the lengths of the flanges so as to prevent longitudinal movement of the device 29 with respect to the handle 22. Preferably, a slot 78 is provided in the tail end to facilitate its compression during application or removal of the device 29.

As best illustrated in FIGS. 6 and 7, a porous material 82 is affixed to the central portion 62 of the base. The porous material, which is preferably compressed cellulose that expands when it becomes wet, has an oral hygiene agent dispersed therein in a dry form. Such agent, in one embodiment, is a mouthwash or disclosing agent designed to provide a visual indication when applied to a tooth of the presence of plague, foreign material, or materia alba. In another embodiment, the oral hygiene agent is applied to the gums and incorporates an oxidizing agent, an alkaline material, and, possibly, a flavoring agent to mask the flavor of the oxidizing agent and alkaline material. In another embodiment, the material incorporated in the porous material is a herbal agent, which may be a combination of agents, or flavors. In another embodiment the material incorporated in the porous material is a fluoride based agent or other agent used to retard or reduce dental decay. In another embodiment is the use of a palliative agent such as a topical anesthetic and/or an antiseptic agent for treatment of oral irritations.

When a user desires to apply an oral hygiene agent to his or her gums or teeth, an appropriate device 29 is selected. The device 29 is installed on the tail end 26 by aligning the flanges 64 and 66 with the recesses 77. The tail end then is compressed and the device 29 positioned so that the flanges encompass and releasably engage the ledge surfaces 70 and 72. Location of the device 29 in such position is facilitated by resiliently compressing portions of the tail end on opposed sides of the slot 78. After release of the compressing force, the tail end will exert a force tending to maintain the device 29 in a desired position.

The user then has several options, depending upon the particular device 29 selected. One option is to immerse the porous material 82 in a suitable liquid agent and then apply the agent. Should additional agent be needed, the porous material 82 again would be immersed in the agent. With another alternative, the agent is dispersed in the porous material in a dry form. The user starts the oral hygiene treating procedure by applying the material 82 to his or her gums or teeth. Saliva within the mouth of the user dissolves the agent incorporated in the porous material and controls the rate of application. In still another embodiment, the agent is dispersed in the porous material in a dry form and the porous material is immersed in a suitable liquid, such as water, to dissolve the oral hygiene agent. The porous material is then applied to the teeth or gums of the user to dispense the agent. It should be readily apparent that several oral hygiene devices 29 incorporating different agents can be used during any particular oral hygiene procedure to obtain a desired result.

Figure 8:
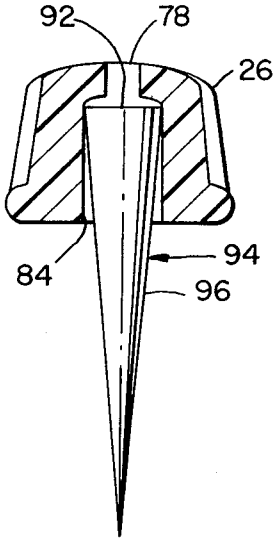
FIG. 8 is a sectional view illustrating another embodiment of an oral hygiene device usable with a toothbrush assembly similar to that of FIG. 1.

Referring now to FIGS. 5 and 7, it can be noted that the tail end 26 is provided with a bore 84. Preferably, as best illustrated in FIG. 5, the bore 84 is centered on the slot 78. As best illustrated in FIG. 8, such oral hygiene device is provided in the form of a stimulator 96 carried by the base 92. A base 92 of an oral hygiene device 94 is insertable into the bore 84. It is preferable for the diameter of the base 92 to be slightly larger than the diameter of the bore so that insertion of the base 92 into the bore forces portions of the tail end 26 away from each other so that a resilient holding force is applied by the tail end to the base. Also, the base can be forcibly ejected from the bore 84 by insertion of an appropriate instrument, through the open upper end of slot 78, into the upper end of the bore 84.

While FIG. 8 illustrates solid stimulator, it should be appreciated that the stimulator could be hollow. Also, a device similar to the PROXABRUSH distributed by J.O. Butler Co. of Chicago, Ill. could be inserted into the bore 84.

Figure 9:
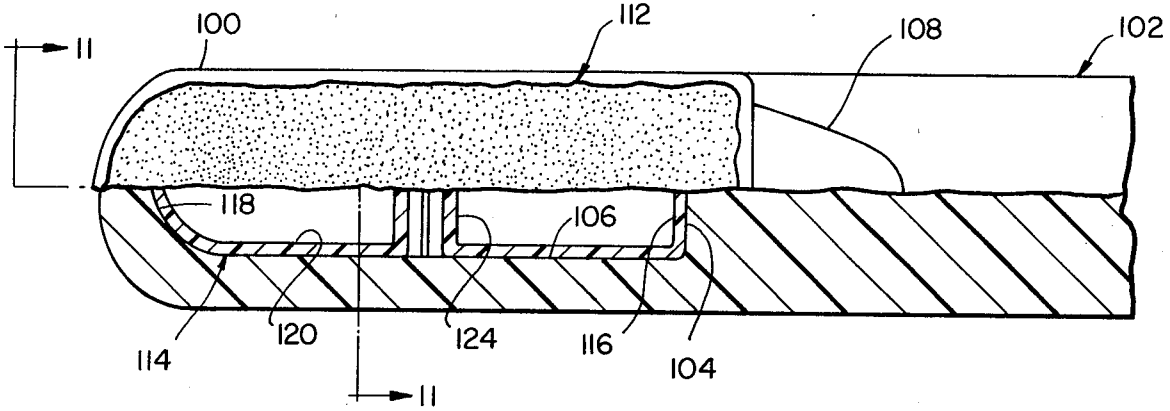
FIG. 9 is a view along line 9—9 of FIG. 11 of a modification of the handle and a modification of the oral hygiene device of the toothbrush assembly of FIG. 1.
Figure 10:
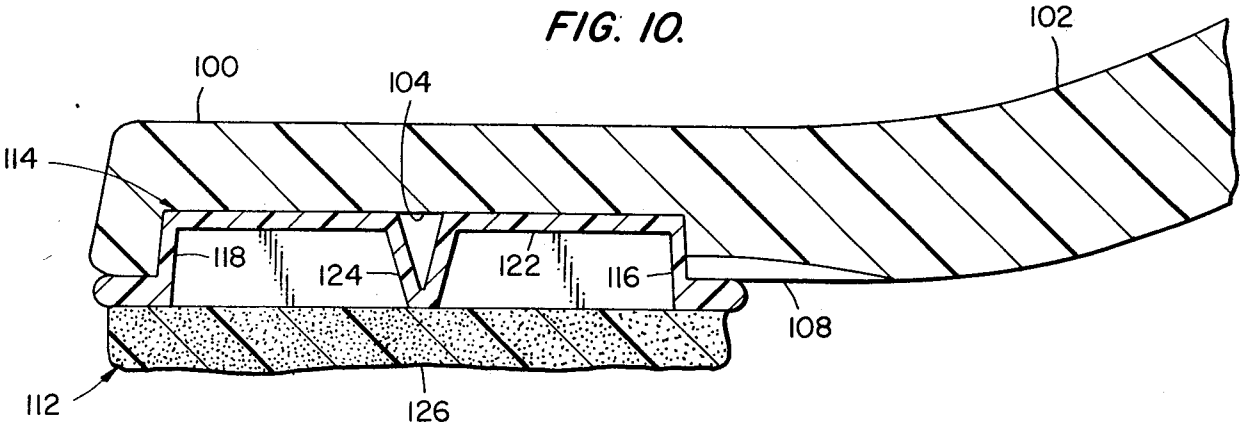
FIG. 10 is a view along line 10—10 of FIG. 11.
Figure 11:
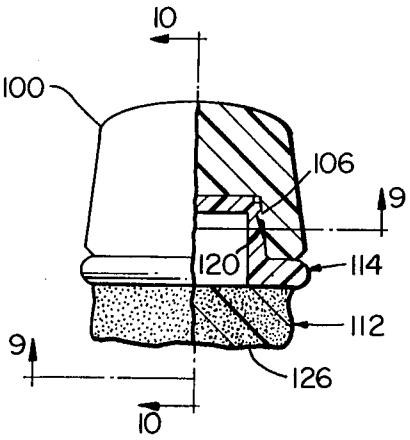
FIG. 11 is a view along line 11—11 of FIG. 9.

Referring now to FIGS. 9 to 11, a modification is illustrated of the tail end of the toothbrush assembly illustrated in FIG. 1.

As best illustrated in FIGS. 9 and 10, a tail end 100 of a handle 102 has a recess 104 formed therein. One or more protrusions 106 extend from side walls defining the recess into the interior of the recess. Preferably, the recess 104 is symmetrical about a longitudinal axis of the handle and is asymmetrical with respect to a transverse axis. A shallow indented or recessed portion 108 is provided forward of the leading end of the recess 104.

FIGS. 9 to 11 illustrate one embodiment of an oral hygiene device 112 that is insertable into the recess 104 and releasably engageable with the tail end 100. The device 112 has a base 114 provided with a front wall 116, a rear wall 118, side walls 120, and a bottom wall 122. The walls cooperate with each other to define a reservoir containing an oral hygiene agent in a dry form, such as a powder form. In one embodiment, a dividing wall 124 is positioned in the reservoir to form separate compartments. Provision of the dividing wall makes it possible to use agents that would react with each other in the absence of the dividing wall. The dividing wall also provides support for the porous material 126 covering the reservoir. It can be noted from FIG. 10 that outer edges of the porous material 126 are supported by flanges protruding outwardly from the walls of the base.

Preferably, one or more protrusions or interference bumps are provided on at least one of the walls forming the base. Such bump(s) is(are) positioned to engage the portion 106 to releasably retain the base 114 in the recess 104. Alternatively, interference recesses can be provided in either the recess or the base. When the base is inserted into the recess, the bump or bumps on the wall of the base ride over the bump or bumps of the recess and then snap into position to prevent inadvertent removal of the base from the recess. It should be readily apparent that other suitable structural relationships can provide the desired means for releasably retaining the walls of the base 114 in the tail end recess 104. The shallow indented or recessed portion 108 facilitates engagement of a flange of the base so that the base can be forcibly ejected from the recess.

With the embodiment of the oral hygiene device illustrated in FIGS. 9 to 11, it is preferable for an oral hygiene agent to be disposed in the reservoir of the base in either a solid or a powder form. For instance, an oxidizing agent is disposed in one of the compartments of the reservoir and an alkaline material is disposed in the other compartment of the reservoir. The porous material 126 retains the agents within the separate compartments and prevents mixing of the agents. The wall 124 prevents the material 126 from entering into the reservoir. When the porous material is wetted, liquid passes through the material into the reservoir and dissolves the oral hygiene agent or agents in the reservoirs. The agent or agents then migrate through the porous material and are applied to the teeth or gums of a user. Preferably a flavoring agent, such as spearmint, is incorporated in the porous material to mask the flavor of the agent or agents. It is also possible to use a herb or herbal combination to provide the oral hygiene agent.

Figure 12:
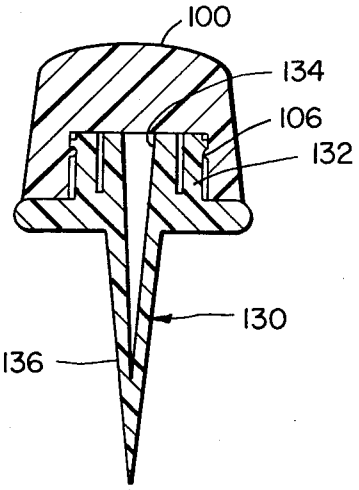
FIG. 12 is a sectional view of another embodiment of an oral hygiene device usable with the embodiment of the handle of the toothbrush assembly illustrated in FIG. 9.

Referring now to FIG. 12, another oral hygiene device 130 is illustrated. The device 130 has a base 132 with an external configuration substantially the same as the base 114 of the oral hygiene device 112. The internal portion of the base is provided with reinforcing ribs 134 and a stimulator 136. Preferably, the configuration of the base 132 is such that the stimulator 136 is positioned close to the rear of the tail end. As previously mentioned, the recess 104 preferably has an asymmetrical shape so that the base 132 is insertable in only one orientation into the recess.

From the preceding description, it should be readily apparent that numerous oral hygiene implements are associatable with the base of the oral hygiene device releasably engaged with the tail end of the toothbrush handle. Previously, representative embodiments of such implements have been described for the purposes of illustrating the general concepts of the present invention. It should be readily apparent, however, that other embodiments of the oral hygiene implements and oral hygiene devices are usable with the present invention. For instance, the stimulator or pick can be rotatable with respect to the bore, with the embodiment illustrated in FIG. 8, or rotatable with respect to the base, in the embodiment illustrated in FIG. 12. This modification would allow the user to locate the stimulator in different positions so that the base of a triangularly shaped stimulator could be reoriented to correspond to the orientation of the triangular shaped embrassure formed between adjacent teeth and gum tissue. Since the base of the embrassure is different on upper teeth and lower teeth, this capability will enable the user to appropriately orient the stimulator for the particular location to be cleaned.

From the preceding, it should be apparent that numerous advantages are provided by the toothbrush assembly according to the present invention. For instance, the brush assembly releasably connected to the head end can be replaced as soon as the bristles lose their desired resiliency, without a need to discard either the handle or the oral hygiene device engaged with the handle. Alternatively, should the oral hygiene device lose its effectiveness prior to the bristles losing their effectiveness, the oral hygiene device can be replaced without a need to replace the bristles. Further, since several different types of oral hygiene devices can be associated with the handle, there is no need to provide storage space within a medicine cabinet for numerous different types of dental implements or oral hygiene devices. There is a need to provide storage for only one handle and storage for the different devices associatable with the handle. For instance, suitable oral hygiene devices and replacement bristles are provided in a storage cassette. A portion of the cassette is shaped to enter into the recess in the head end to forcibly eject the brush assembly Further, incorporation in the oral hygiene device of gum treating agents, such as oxidizing agents and alkaline materials, together with an appropriate flavoring agent, simplifies the application of treating agents to the gums of a user.

The preceding and other advantages provided by the present invention should be readily apparent to those skilled in the art. Also, it should be appreciated that the previously described embodiments of the present invention have been set forth for illustrative purposes only. It is the intention that the present invention be limited only by the appended claims.

What is claimed is:

1. A handle for a toothbrush comprising:

a head end having a head end recess formed therein shaped for releasable engagement with a base carrying bristles;

a tail end having a portion thereof shaped for releasable engagement with an oral hygiene device; and a region intermediate said head end and said tail end shaped for engagement by a user of the toothbrush;

wherein said head end recess has a bottom opening and a top opening, portions of the head end defining the bottom opening being engageable with the base to prevent ingress of material into said head end recess, said head end recess having an upper portion with a cross-sectional area less than the cross-sectional area of said bottom opening, portions of the head end defining the upper portion of the head end recess being shaped for engagement with an upper portion of the base, said base being accessible through said top opening so that said base can forcibly ejected from said head end recess;

wherein said upper portion of said base has an upper part which is outwardly flared, and said top opening of said head end recess has an upper portion which is outwardly flared and an intermediate portion which is inwardly tapered, said upper portion of said base being further provided with a plurality of angularly oriented slots extending in a direction perpendicular to said base; and wherein, when said base is inserted into said head end recess, said upper portion of said base is laterally compressed on opposite sides of said plurality of angularly oriented slots so that said outwardly flared upper part of said upper portion of said base clears said inwardly tapered intermediate portion of said top opening of said head end recess;

whereby said upper portion of said base is seated firmly in said top opening of said head end recess in such a manner that is is restrained in a plurality of lateral directions corresponding to the angular orientations of said plurality of angularly oriented slots.

2. A handle according to claim 1, wherein said tail end has a tail end recess formed therein, the oral hygiene device having a base insertable into said tail end recess, portions of said tail end defining said tail end recess being engageable with walls of the base of the oral hygiene device when the base of the oral hygiene device is forcibly inserted into the tail end recess, whereby to releasably retain the base of the device in the tail end recess.

3. A handle according to claim 2, wherein a portion of the tail end adjacent the tail end recess is indented so as to provide access to a wall of the base of the oral hygiene device to facilitate removal of the device from the tail end recess.

4. A handle for toothbrush comprising:

a head end having a recess formed therein shaped for releasable engagement with a base carrying bristles;

a tail end having a portion thereof shaped for releasable engagement with an oral hygiene device; and a region intermediate said head end and said tail end shaped for engagement by a user of the toothbrush;

wherein said tail end has a slot formed therein extending parallel to a longitudinal axis of the handle so that portions of the tail end on opposite sides of the slot are movable toward each other to reduce the width of the tail end to facilitate placement of the oral hygiene device on, and removal of the oral hygiene device from, the tail end of the toothbrush; and wherein said tail end has ledge surfaces protruding outwardly from each side surface theref on opposite sides of said slot, the oral hygiene device having a base with upstanding flanges shaped to mate with and encompass said ledge surfaces, whereby, when it is desired to place the oral hygiene device on the tail end, said portions of the tail end on opposite sides of the slot are moved toward each other to reduce the width of the tail end, the oral hygiene device is placed on the tail end so that the upstanding flanges encompass the ledge surfaces, and, when the opposite sides of the slot are released, the upstanding flanges connnectively engage said tail end.

5. A handle according to claim 4, wherein a bore is defined in said tail end centered on said slot, the oral hygiene device having a base inserted into said bore and retained in said bore by frictional forces.

6. An oral hygiene device releasably engageably with a tail end of a handle, said device comprising:

a base shaped for releasable engagement with the tail end of the handle; and an oral hygiene implement carried by said base;

wherein the tail end has a tail end recess formed therein, said base having side walls insertable into said tail end recess and carrying retaining means engageable with portions of the tail end defining the tail end recess when the base is forcibly inserted into the tail end recess for releasably retaining said base in said tail end recess; and wherein the tail end recess has side walls, and said retaining means comprises at least one interference bump in the side walls of said base;

whereby said base is easily inserted into and removed from the tail end recess when the oral hygiene device is not in use, and said base is firmly held in the tail end recess by engagement of said at least one interference bump with corresponding at least one of the side walls of the tail end recess when the base is in said tail end recess and the oral hygiene device is in use.

7. An oral hygiene device according to claim 6, wherein said oral hygiene implement is a stimulator supported by and protruding from said base.

8. An oral hygiene device releasably engageable with a tail end of a handle, said device comprising:

a base shaped for releasable engagement with the tail end of the handle; and an oral hygiene implement carried by said base;

wherein the tail end has a tail end recess formed therein, said base having side walls insertable into said tail end recess and carrying retaining means engageable with portions of the tail end defining the tail end recess when the base is forcibly inserted into the tail end recess for releasably retaining said base in said tail end recess; and wherein said base side walls define a reservoir, said oral hygiene implement comprising a liquid soluble oral hygiene agent in a dry form disposed in said reservoir, and a porous covering material closing said reservoir to retain the agent therein, the covering material allowing passage of liquid into the reservoir to dissolve the agent and controlling the subsequent rate of passage of the dissolved agent out of the reservoir during an oral hygiene procedure.

9. An oral hygiene according to claim 8, wherein said covering material is impregnated with a flavoring agent to mask the taste of the dissolved agent.

10. An oral hygiene device releasably engageable with a tail end of a handle, said device comprising:

a base shaped for releasable engagement with the tail end of the handle; and an oral hygiene implement carried by said base;

wherein the tail end has a tail end recess formed therein, said base having side walls insertable into said tail end recess and carrying retaining means engageable with portions of the tail end defining the tail end recess when the base is forcibly inserted into the tail end recess for releasably retaining said base in said tail end recess; and wherein the tail end of the handle has a flat lower surface and ledge surfaces protruding outwardly from each side surface thereof, said base having a central portion positionable in contact with the tail end flat lower surface and flanges protruding upwardly from opposed side edges of the central portion, said flanges being shaped to mate with and encompass said ledge surfaces to thereby releasably engage said base with said tail end.

11. An oral hygiene device according to claim 10, wherein the tail end of the handle has a longitudinally extending slot formed therein and a bore centered on the slot, said base being insertable into said bore and said implement comprising a stimulator supported by said base.

12. An oral hygiene according to claim 10, wherein said oral hygiene implement comprises a porous material covering the central portion of said base and a liquid soluble oral hygiene agent dispersed in a dry form within said porous material, said porous material controlling application of the agent during an oral hygiene procedure.

13. A replaceable brush assembly engageable with an open-ended recess in a head end of a toothbrush handle, the recess having a lower portion and an upper portion, the upper portion having a cross-sectional area less than that of the lower portion, said assembly comprising:

a base having a lower portion receivable in the lower portion of the recess and an upper portion receivable in the upper portion of the recess, the upper portion of the base having a plurality of angularly oriented slots formed therein and extending in a direction perpendicular to said base so that the external configuration thereof is resiliently reducible in size during insertion of the base into the recess; and a plurality of bristles carried by and protruding from said base lower portion, said base lower portion being engageable with walls defining said recess so as to prevent ingress of material into said recess;

wherein said upper portion of the base has an outwardly flared portion, said portion of the base being compressed inwardly toward said plurality of angularly oriented slots when said base is inserted into said recess, and said upper portion of said recess having an indented portion which cooperates with said outwardly flared portion of said upper portion of the base to lock said base in said recess when said base in fully inserted into said recess;

whereby said base is retained in said recess and is restrained in a plurality of lateral directions corresponding to the angular orientations of said plurality of slots.

14. A toothbrush assembly comprising:

a handle having a head end with a recess formed therein shaped for releasable engagement with a base carrying bristles, and a tail end shaped for releasable engagement with an oral hygiene device;

a brush assembly having bristles and a base carrying said bristles, said base being positioned in said recess and releasably engaged with said head end of said handle; and an oral hygiene device releasably engaged with said tail end of said handle;

wherein said tail end has a slot formed therein extending parallel to a longitudinal axis of the handle so that portions of the tail end on opposite sides of the slot are movable toward each other to reduce the width of the tail end to facilitate placement of the oral hygiene device on, and removal of the oral hygiene device from, the tail end; and wherein said tail end has ledge surfaces protruding outwardly from each side surface thereof on opposite sides of said slot, the oral hygiene device having a base with upstanding flanges shaped to mate with and encompass said ledge surfaces, whereby, when it is desired to place the oral hygiene device on the tail end, said portions of the tail end on opposite sides of the slot are moved toward each other to reduce the width of the tail end, the oral hygiene device is placed on the tail end so that the upstanding flanges encompass the ledge surfaces, and, when the opposite sides of the slot are released, the upstanding flanges connectively engage said tail end.

15. An oral hygiene device releasably engagable with a tail end of a handle, said device comprising:

a base shaped for releasable engagement with the tail end of the handle; and an oral hygiene implement carried by said base;

wherein the tail end has a tail end recess formed therein, said base having side walls insertable into said tail end recess; and wherein said base side walls define a reservoir for holding a liquid soluble oral hygiene agent in a dry form disposed in said reservoir, said hygiene implement comprising a porous covering material closing said reservoir to retain the agent therein, the covering material allowing passage of liquid into the reservoir to dissolve the agent and controlling the subsequent rate of passage of the dissolved agent out of the reservoir during an oral hygiene procedure;

wherein the tail end recess has side walls, and said side walls of said base include at least one interference bump provided thereon;

whereby said base is easily inserted into and removed from the tail end recess when the oral hygiene device is not in use, and said base is firmly held in the tail end recess by engagement of said at least one interference bump with corresponding at least one of the side walls of the tail end recess when the base is in said tail end recess and the oral hygiene device is in use.

16. A handle for a toothbrush comprising:

a head end having a head end recess formed therein shaped for releasable engagement with a base carrying bristles;

a tail end having a portion thereof shaped for releasable engagement with an oral hygiene device; and a region intermediate said head end and said tail end shaped for engagement by a user of the toothbrush;

wherein said head end recess has a bottom opening and a top opening, portions of the head end defining an upper portion of the head end recess being shaped for engagement with an upper portion of the base;

wherein said upper portion of said base has an upper part which outwardly flared, and said top opening of said head end recess has an upper portion which is outwardly flared and an intermediate portion which is inwardly tapered, said upper portion of said base being further provided with a plurality of angularly oriented slots extending in a direction perpendicular to said base; and wherein, when said base is inserted into said head end recess, said upper portion of said base is laterally compressed on opposite sides of said plurality of angularly oriented slots so that said outwardly flared upper part of said upper portion of said base clears said inwardly tapered intermediate portion of said top opening of said head end recess;

whereby said upper portion of said base is inserted firmly in said top opening of said head end recess in such a manner that it is restrained in a plurality of lateral directions corresponding to the angular orientations of said plurality of angularly oriented slots.

17. A handle according to claim 16, wherein said tail end has a tail end recess formed therein, the oral hygiene device having a base insertable into said tail end recess, portions of said tail end defining said tail end recess being engageable with walls of the base of the oral hygiene device when the base of the oral hygiene device is forcibly inserted into the tail end recess, whereby to releasably retain the base of the device in the tail end recess.

18. A handle according to claim 17, wherein a portion of the tail end adjacent the tail end recess is indented so as to provide access to a wall of the base of the oral hygiene device to facilitate removal of the device from the tail end recess.

* * * * *